US007877838B2

(12) United States Patent
Bos

(10) Patent No.: US 7,877,838 B2
(45) Date of Patent: Feb. 1, 2011

(54) CLEANING APPARATUS, SUCH AS FOR SYNTHETIC GRASS

(75) Inventor: Anton Cornelis Bos, Doorn (NL)

(73) Assignee: Redexim Handel-En Exploitatie MIJ. B.V. (NL)

( * ) Notice: Subject to any disclaimer, the term of this patent is extended or adjusted under 35 U.S.C. 154(b) by 744 days.

(21) Appl. No.: 11/666,379

(22) PCT Filed: Oct. 25, 2005

(86) PCT No.: PCT/NL2005/000765

§ 371 (c)(1),
(2), (4) Date: Aug. 31, 2007

(87) PCT Pub. No.: WO2006/046863

PCT Pub. Date: May 4, 2006

(65) Prior Publication Data

US 2009/0106930 A1 Apr. 30, 2009

(30) Foreign Application Priority Data

Oct. 26, 2004 (NL) ..... 1027347

(51) Int. Cl.
*A47L 5/14* (2006.01)
*E01H 1/08* (2006.01)

(52) U.S. Cl. ..... 15/345; 15/340.3; 15/346; 15/352; 15/383; 15/339

(58) Field of Classification Search ..... 15/340.3, 15/345, 346, 352, 383, 339; *A47L 5/14; E01H 1/08*
See application file for complete search history.

(56) References Cited

U.S. PATENT DOCUMENTS 3,918,118 A * 11/1975 Vom Berg et al. ..... 15/83
6,154,922 A * 12/2000 Vanderlinden ..... 15/346

FOREIGN PATENT DOCUMENTS

DE 19715435 * 10/1998

* cited by examiner

*Primary Examiner*—David A Redding
(74) *Attorney, Agent, or Firm*—The Nath Law Group; Laurie A. Axford

(57) ABSTRACT

The invention relates to an apparatus for cleaning a ground surface of synthetic grass and a filler comprising a frame (4), moving and supporting means (5) arranged on the frame (4) for moving the apparatus over the ground surface, cleaning means for the filler arranged on the frame (4), wherein the cleaning means comprise at least one cleaning space for the filler and an air pump (14), wherein a suction side of the air pump (14) is connected to the cleaning space, wherein supply means (25-29, 30) are arranged on the frame for supplying the filler to the cleaning means. Moreover, a pressure side of the air pump is connected to the supply means.

10 Claims, 4 Drawing Sheets

CLEANING APPARATUS, SUCH AS FOR SYNTHETIC GRASS

The invention relates to an apparatus for cleaning a ground surface of synthetic grass and a filler, comprising a frame, moving and supporting means arranged on the frame for moving the apparatus over the ground surface, cleaning means for the filler arranged on the frame, wherein the cleaning means comprise at least one cleaning space for the filler and an air pump, wherein a suction side of the air pump is connected to the cleaning space and wherein supply means are arranged on the frame for supplying dirt, such as the filler to be cleaned, to the cleaning means.

Such an apparatus is known for instance from American patent application US 2003/0037388. The apparatus travels over a ground surface. Dirt and filler are supplied to a cleaning chamber using a brush, wherein filters allow cleaned filler to be placed back on the ground surface. Finely contaminated material is suctioned up with an air pump and the dirty material is filtered.

Figures 4, 5:
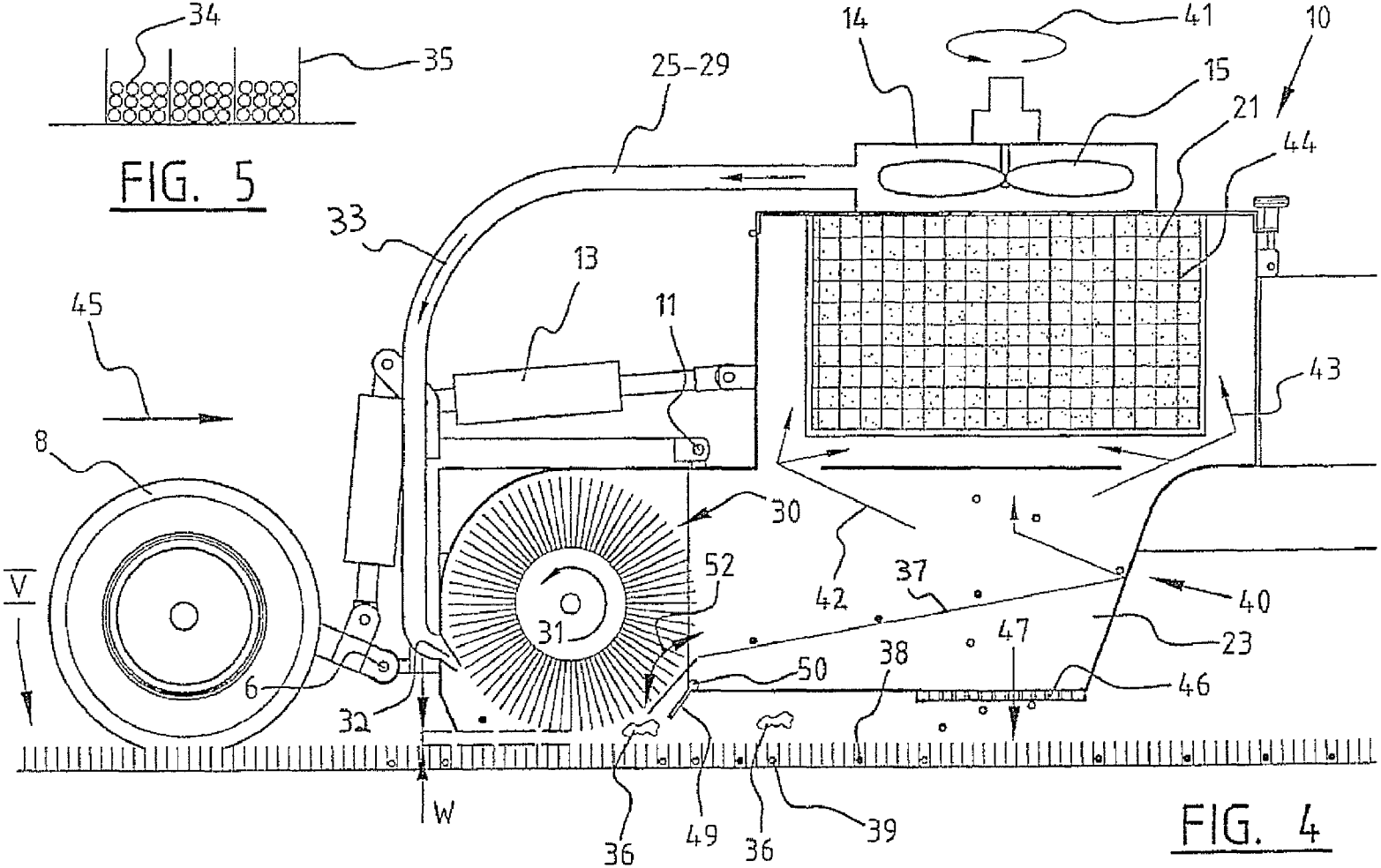

A ground surface such as a synthetic grass is shown schematically in FIG. 5, wherein a filler 34, such as rubber balls, is arranged between blades 35 of the synthetic grass. Such a filler strengthens the synthetic grass and counteracts wear. Sand or a composite can also be arranged.

A problem in prior art cleaning apparatus is damaging of the synthetic grass by the brushes. The object of the invention is to provide a cleaning apparatus which causes less damage to the synthetic grass.

According to another aspect of the invention, it is an object to provide a cleaning apparatus for synthetic grass which is less noisy.

This object is achieved according to the invention in that a pressure side of the air pump is connected to the supply means. On the one hand sound-damping of the air pump is hereby obtained, and on the other the supply means are reinforced by the supply of air. Power already available on the cleaning apparatus is thus used efficiently. By feeding air to the supply means the available supply means, such as a brush, will be able to operate at lower power, or the power can be used for other purposes. The air pump is a device with an air cleaning side and a pressing side.

The apparatus preferably has a discharge means for cleaned filler from the cleaning chamber, wherein this discharge means is arranged in front of the supply means as seen in the direction of travel of the apparatus. During use of the apparatus cleaned filler is hereby placed back in each case and, as the apparatus moves further, optionally cleaned again. This provides a better result.

The supply means connected to the air pump preferably comprise an air blowing means, preferably with an adjustable spout. The airflow generated by the air pump can hereby be directed with the air outlets at the ground surface, and thus be used more readily as additional supply means for filler from the ground surface to the cleaning chamber. The strong airflow causes dirt in the synthetic grass surface to be dislodged. A number of adjustable air outlets are preferably arranged over the operating width of the supply means.

The apparatus is preferably provided with adjusting means for adjusting a working height of the supply means. An adjustment can hereby be made of the degree to which the apparatus cleans. The adjusting means are preferably adapted to cause the supply means to operate above the level of the moving means. The supply means thus do not come into contact with the ground surface of synthetic grass, or hardly so, whereby damage to the synthetic grass is limited to a minimum. The supply means preferably move above the level of the ground surface and use is made of only the low impact of the airflows generated with the supply means, such as the brush which is mounted for rotation on the frame, and the supplied air. The air supply and a brush form the supply means for dirt and filler to the cleaning chamber.

The apparatus preferably comprises coupling means for coupling the apparatus to a drive vehicle. The apparatus can hereby be assembled without its own drive means. Costs can hereby be kept low. The coupling means comprise on the one hand coupling means enabling pulling of the cleaning apparatus, and on the other coupling. means for transmitting a drive to the cleaning apparatus. Pneumatic or hydraulic means are preferably used. The skilled person is familiar with the arrangement of coupling means for pneumatic or hydraulic devices.

The cleaning chamber is preferably provided with a shake sieve device. This device feeds back the material to be replaced while shaking it, thereby resulting in improved cleaning. The shake sieve device is arranged in or close to the discharge for cleaned filler. The cleaning chamber can be provided with extra cleaning means. A cleaning liquid can be supplied, such as a soap or a chlorine. Dirt and filler can also be further accelerated, for instance with an additional brush and so on.

According to a further embodiment, a flap is arranged between the supply means and the cleaning means for regulating the degree to which the apparatus cleans. The entrance to the cleaning chamber can be made larger or smaller by pivoting the flap. The flap is arranged in the path over which the fillers normally travel when they are carried in the direction of the cleaning chamber by the supply means.

The cleaning space is preferably connected for tipping to the frame. The cleaning space in which contaminant material is collected is hereby easy to empty. During use in cleaning the ground surface, paths are followed over the ground surface, for instance in directions extending in each case in length or width direction of the field. The cleaning space is emptied at the end of such a path. Pneumatic or hydraulic means are preferably arranged to tip the cleaning chamber. The waste can hereby be tipped each time on or outside the field for cleaning. This can optionally be collected with another device. Waste can also be tipped into a specially adapted vehicle.

The flap is preferably connected hingedly to the cleaning chamber for the purpose of closing a feed opening to the cleaning chamber in the tipped situation. This prevents that dirt can be carried out of the cleaning chamber back to the supply means during tipping. An exceptionally efficient apparatus is hereby obtained wherein the flap has a dual function.

Figure 1:
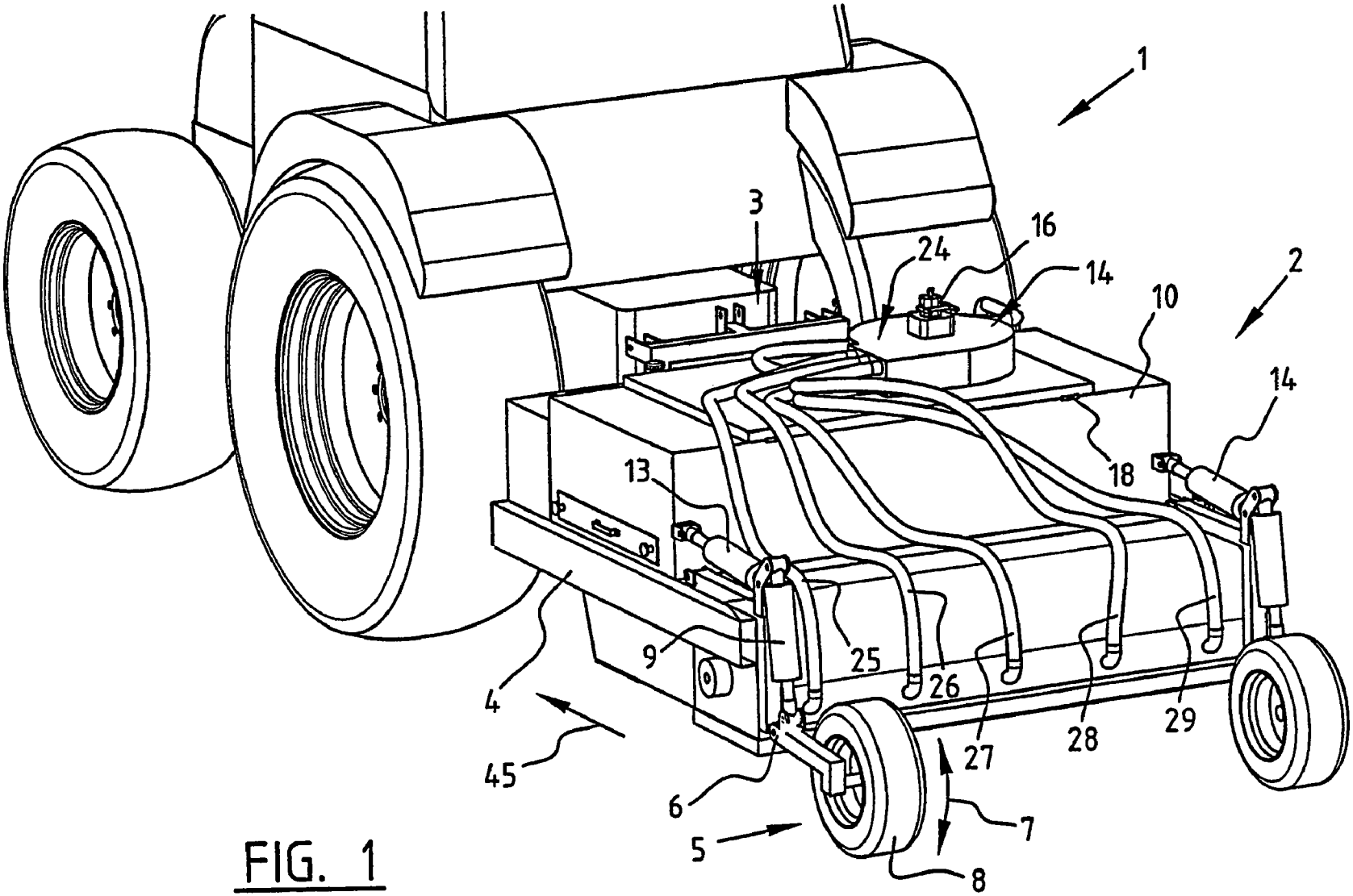
Figure 2:
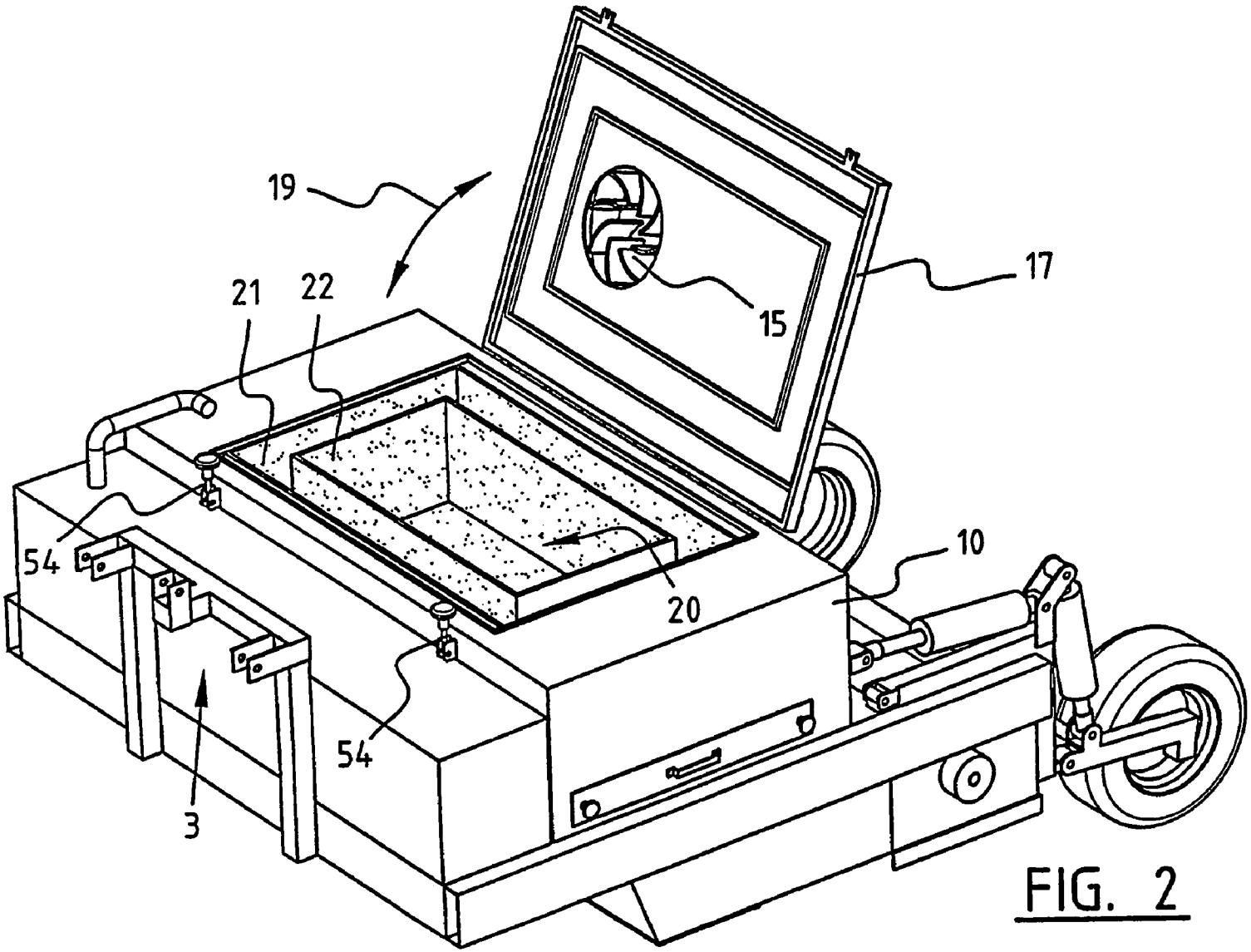
Figure 3:
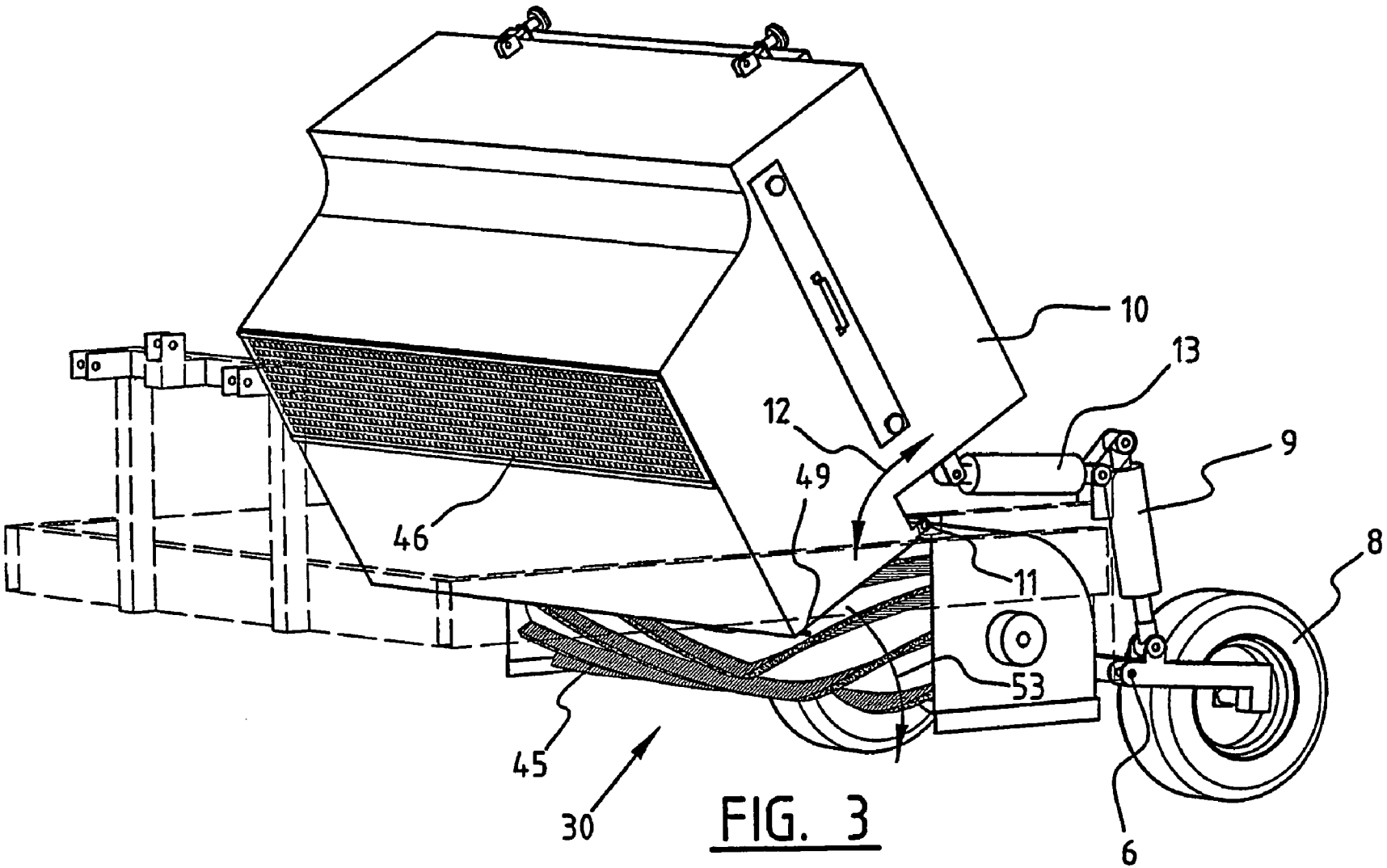

The invention will be further described with reference to the accompanying drawings, in which:

FIG. 1 shows a perspective view of a cleaning apparatus according to a first embodiment, FIG. 2 shows a perspective view of the first embodiment of the cleaning apparatus, FIG. 3 shows a perspective view of the cleaning apparatus with tipped cleaning chamber, FIG. 4 shows a cross-section in the travel direction of the cleaning apparatus, FIG. 5 shows a ground surface, such as a synthetic grass.

FIG. 1 shows a tractor 1 which is coupled to a cleaning apparatus 2 according to the invention. Tractor 1 can be a random tractive vehicle with which cleaning apparatus 2 can be carried over a ground surface (not shown). Coupling means 3 are shown schematically. The coupling means comprise a coupling whereby tractor 1 can pull cleaning apparatus 2 and coupling means for driving the different components of cleaning apparatus 2. These latter are not shown. These can be hydraulic, pneumatic and/or mechanical couplings, whereby cleaning apparatus 2 can be embodied without its own drive means for the respective components thereof. All movable parts of the cleaning apparatus, such as brushes, air pump, cylinders, can be driven hydraulically or pneumatically. This will be described below in more detail.

Cleaning apparatus 2 comprises a frame 4 to which moving means 5 are pivotally connected. Pivot 6 enables movement of the bearing-mounted wheel 8 as according to arrow 7. The movement according to arrow 7 can be controlled by adjusting means 9 formed by a hydraulic or pneumatic cylinder. The cylinder is connected hingedly to the frame and to moving means 5. Cylinder 9 is connected to the drive means arranged for instance on tractor 1. By moving the moving means 5 as according to arrow 7 the working height, i.e. the distance between the cleaning means, see below, and the ground surface, can be adjusted. This is indicated in FIG. 4 with the letter W.

A tiltable part 10 is connected to frame 4. Via a hinge 11 part 10 is movable as according to arrow 12 by means of cylinders 13,14 which are hingedly connected to part 10 on one side and the frame on the other. Cylinders 13,14 can be driven by means of a pneumatic or hydraulic system coupled to tractor 1. In the tipped position of FIG. 3 the cleaning chamber 23 arranged in part 10 can be emptied.

Part 10 comprises the suction and pressure device 14 which comprises a bearing-mounted fan 15. Motor 16 of suction and pressure device 14 is connected to drive means arranged for instance on tractor 1. This can be an electric motor or a pneumatic/hydraulic motor. It is preferably a hydraulic or pneumatic motor so that all components that have to be driven on the cleaning apparatus can be connected by means of coupling means to devices arranged for this purpose on tractor 1.

The suction and pressure device 14 is arranged on a cover 17 connected to part 10 by means of a hinge 18. Cover 17 is thus movable as according to arrow 19. The opened situation of cover 17 is shown in FIG. 2. In FIG. 2 the filter chamber 20 can be seen in which a number of filters are arranged. Filter chamber 20 comprises a coarse filter 21 and a fine filter 22, wherein suction and pressure device 14 draws in air from the interior of filter chamber 20. Air is drawn out of cleaning chamber 23 arranged in tiltable part 10.

The suction and pressure device will suction air and finer particles out of cleaning chamber 23, wherein the fine contaminants are stopped in the respective filters depending on the size of the fine particles. The air which enters the suction and pressure device 14 through filters 21,22 is cleaned.

The cleaned air is discharged via the pressure side of suction and pressure device 14. The pressure side, designated schematically with 24 in FIG. 1, is connected to, in this embodiment, five hoses 25-29. The suctioned air is used via these hoses 25-29 as supply means for supplying the filler and contamination to cleaning chamber 23. This is shown in FIG. 4. A second supply means is also shown, i.e. brush 30 which is connected in bearing-mounted manner to frame 4 and can rotate as according to arrow 31. The brush is driven with a suitable motor.

As stated above, the working height W of brush 30 can be changed with adjusting means 9. A nozzle. 32 is arranged on the outer end of hoses 25-29. The airflow 33 can be directed herewith.

The supply means formed by brush 30 and hoses 25-29 are used to carry filler 34 and possible contaminants 36 into cleaning chamber 23 as according to arrow 37. Filler 34 is arranged between synthetic grass 35, as shown schematically in FIG. 5. The dirt 36 lies. loosely on or between the synthetic grass. The filler 34 may be soiled, such as granule 38, for instance by algal growth and the like, but may also be clean, such as granule 39.

The filler is carried into cleaning chamber 23 at a high speed. It herein collides with the side walls, as shown for instance at 40, or through mutual collision. Possible soiled filler will be cleaned by the collisions, wherein the dirt is dislodged from the filler. Other dirt is carried into cleaning chamber 23. The airflow indicated with arrows 42,43 which is generated by fan 15, which rotates as according to arrow 41, provides a suction action as according to these arrows in the direction of filter chamber 20. Finely distributed dirt will be entrained in the airflow and collected in filter 21.

Filter 21 is a known filter material which is arranged on gratings 44. Filter material 21,22 is easily replaceable when it is saturated with fine particles.

During use the cleaning apparatus will move as according to arrow 45. Dirt 36 and filler 34 will be carried into the cleaning chamber close to supply means 30,32. It will be possible for cleaned filler to be fed back to the grass field as according to arrow 47 via a filter 46, for instance a grating 46 of suitable dimensions. Fed back filler will be cleaned once again with a further movement as according to arrow 45. Such a cleaning has a better effect. Owing to the forward movement of the cleaning vehicle the filler will be picked up and cleaned several times. After cleaning the filler is re-placed and can optionally be cleaned once again.

The degree to which the apparatus cleans can be adjusted by means of adjusting means 9 by changing the working height W. A setting is preferably used as shown in FIG. 4, wherein the outer end of brush 30 is situated a small distance above synthetic grass 35. As a result the synthetic grass 35 is not touched, or hardly so, by brushes 48 of brushing means 30. No damage, or hardly any, hereby occurs. When the degree to which the apparatus cleans must be increased, the working height can be lowered and the brush can be brought into contact with the synthetic grass.

The degree to which the apparatus cleans can further be changed by adjusting the flap 49 which is connected by means of a hinge 50 to part 10. Flap 49 is pivotable as according to arrow 52. The flap can be arranged in the path 37 of filler and dirt 36. In the situation shown in FIG. 4, the flap is open to the maximum and the degree to which the apparatus cleans is maximal. A suitable drive means, such as a hydraulic or pneumatic motor, can be connected to flap 49 for the movement according to arrow 52.

Flap 49 has a second function. In the tipped situation according to FIG. 3, flap 49 can be used as blocking means for collecting dirt left behind in cleaning chamber 23. By placing the flap in the position shown in FIG. 3, dirt will collect on the flap. The cleaning chamber can be emptied by placing the flap back in the position shown in FIG. 4, wherein the dirt can drop out of cleaning chamber 23 as according to arrow 53 onto the ground surface. When one strip at a time of a synthetic grass field is cleaned with the cleaning apparatus, cleaning chamber 23 can be quickly emptied at the end of this strip, whereby heaps of dirt are collected. The heaps of dirt can be removed from the synthetic grass field with a sweeper device.

FIG. 2 further shows a locking means 54 with which cover 17 can be locked to tiltable part 10.

The invention is shown in a preferred embodiment. The skilled person will also be able to apply the invention as stated in the claims in apparatuses. The invention can be applied on apparatus as shown in American patent application US 2003/0037388, international patent application 98/52456 and German application 44 08 247, wherein all three publications are incorporated by way of reference into the content of this patent application.

What is claimed is:

1. An apparatus for cleaning a ground surface of synthetic grass and a filler, comprising:

a frame;

a moving and supporting device arranged on the frame for moving the apparatus over the ground surface;

a cleaning device positioned on the frame, wherein the cleaning device comprises at least one cleaning chamber, a discharge device, and an air pump, wherein a suction side of the air pump is connected to the cleaning chamber, wherein a supply device is positioned on the frame for supplying the filler to be cleaned to the cleaning device, characterized in that the discharge device discharges cleaned filler from the cleaning chamber onto the ground surface.

2. The apparatus of claim 1, characterized in that the discharge device discharges cleaned filler onto the ground surface underneath the apparatus and in front of the supply device relative to the direction of travel of the apparatus.

3. The apparatus of claim 1, characterized in that the supply device comprises a nozzle.

4. The apparatus of claim 1, further comprising an adjusting device that adjusts a working height of the supply device.

5. The apparatus of claim 4, characterized in that the adjusting device is adapted to cause the supply device to operate above the level of the ground surface with the supply device not contacting the synthetic grass.

6. The apparatus of claim 1, further comprising a coupling device for coupling the apparatus to a drive vehicle.

7. The apparatus of claim 1, characterized in that a flap is arranged between the supply device and the cleaning device for regulating the degree to which the apparatus cleans.

8. The apparatus of claim 1, characterized in that the cleaning chamber is connected for tipping to the frame.

9. The apparatus of claim 7, wherein the cleaning chamber is connected for tipping to the frame, characterized in that the flap is connected hingedly to the cleaning chamber to close a feed opening to the cleaning chamber in a tipped position.

10. The apparatus of claim 1, wherein the supply device comprises a brush.

* * * * *